US006992430B2

(12) United States Patent
Cillessen et al.

(10) Patent No.: US 6,992,430 B2
(45) Date of Patent: Jan. 31, 2006

(54) ELECTRIC DISCHARGE LAMP

(75) Inventors: Johannes Franciscus Maria Cillessen, Eindhoven (NL); Henricus Albertus Maria Van Hal, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/500,510

(22) PCT Filed: Dec. 18, 2002

(86) PCT No.: PCT/IB02/05616

§ 371 (c)(1),
(2), (4) Date: Jun. 29, 2004

(87) PCT Pub. No.: WO03/060951

PCT Pub. Date: Jul. 24, 2003

(65) Prior Publication Data

US 2005/0029949 A1 Feb. 10, 2005

(51) Int. Cl.
*H01J 61/36* (2006.01)

(52) U.S. Cl. ..... 313/331; 313/332; 313/633

(58) Field of Classification Search ..... 313/625, 313/626, 633, 573, 331, 332, 234, 491
See application file for complete search history.

(56) References Cited

U.S. PATENT DOCUMENTS

| | | | | |
|---|---|---|---|---|
| 6,060,829 | A * | 5/2000 | Kubon et al. | 313/631 |
| 6,169,365 | B1 * | 1/2001 | Kubon et al. | 313/631 |
| 6,215,254 | B1 * | 4/2001 | Honda et al. | 315/246 |
| 6,590,342 | B1 * | 7/2003 | Onnekes-Van Der Voort et al. | 313/633 |
| 6,781,292 | B2 * | 8/2004 | Ishida et al. | 313/284 |
| 6,791,266 | B2 * | 9/2004 | Venkataramani et al. | 313/623 |

FOREIGN PATENT DOCUMENTS

| | | |
|---|---|---|
| WO | WO0034980 | 6/2000 |

* cited by examiner

*Primary Examiner*—Ashok Patel

(57) ABSTRACT

An electric discharge lamp comprising: a light-transmissive ceramic lamp vessel (1); a first and a second current conductor (2,3) entering the lamp vessel (1), and each supporting an electrode (4,5) in the lamp vessel (1); an ionizable filling comprising a rare gas and a metal halide in the lamp vessel (1); at least the first current conductor (2) within the lamp vessel (1) being halide-resistant, characterized in that the first current conductor (2) at least substantially comprises a material with an at least substantially isotropic coefficient of thermal expansion, said material preferably being chosen from the group of pentamolybdenum boride disilicide, pentamolybdenum diboride silicide, or a combination of these two materials.

7 Claims, 1 Drawing Sheet

ELECTRIC DISCHARGE LAMP

Figure 1:
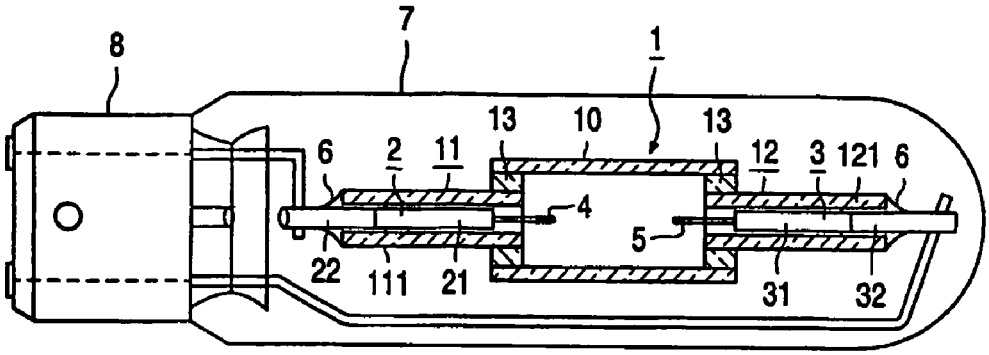

The invention relates to an electric discharge lamp comprising:

a light-transmissive ceramic lamp vessel;

a first and a second current conductor entering the lamp vessel, and each supporting an electrode in the lamp vessel;

an ionizable filling comprising a rare gas and a metal halide in the lamp vessel; at least the first current conductor within the lamp vessel being halide-resistant.

Such an electric discharge lamp is known from WO0034980. A first part of the first current conductor consists of an halide-resistant material, whereas the second part thereof is made of niobium. Niobium is chosen because this material has a coefficient of thermal expansion corresponding to that of the lamp vessel in order to prevent leakage of the lamp. In a particular prior art embodiment said first part is made of pentamolybdenum trisilicide in order to obviate the risk of leakage in case the sealing compound, being either a ceramic, a glass or a combination thereof, also directly connects the first part of the first current conductor to the lamp.

A disadvantage of the electric discharge lamp known from the above PCT-patent application is that if said first part of the first current conductor is made of pentamolybdenum trisilicide, microcracks may occur in this material when it is sintered, particularly at high temperatures and/or densities. These microcracks limit the mechanical strength of the first current conductor and/or may partly "absorb" the ionisable filling in the lamp vessel. Furthermore, the micro cracks introduce porosity which results in leakage, as indicated above.

It is an object of the present invention to obviate this disadvantage.

In order to accomplish that objective, an electric discharge lamp of the type referred to in the opening paragraph according to the invention is characterized in that the first current conductor at least substantially comprises a material with an at least substantially isotropic coefficient of thermal expansion. Said material is preferably chosen from the group of $Mo_5$ $(Si,X)_3$, wherein X is B, Al, N or C, more preferably pentamolybdenum diboride silicide. Extensive research has revealed that the above mentioned microcracks can be attributed to specific thermoelastic properties of pentamolybdenum trisilicide leading to thermal stresses therein. The invention is particularly based on the awareness that the thermoelastic properties of the material used can be improved and that thermal stresses therein can be prevented by proposing a material that has an at least substantially isotropic coefficient of thermal expansion, i.e. a coefficient of thermal expansion exhibiting similar values in all crystallographic directions of the crystal structure of the material used. In accordance with the invention, particularly $Mo_5$ $(Si,X)_3$, wherein X is B, Al, N or C, more in particular pentamolybdenum diboride silicide, appears to have a (nearly) isotropic coefficient of thermal expansion, while it simultaneously meets other requirements: resistant to the ionizable filling of the lamp, particularly to halide (i.e. they should not be attacked by or react with halide or halogen formed therefrom), able to withstand thermal manufacturing and operating conditions of the lamp, thermally stable up to 2000° C., capable of being attached to the electrode, and having sufficient electrical conductivity to preclude electrical losses.

In one preferred embodiment of an electric discharge lamp according to the invention, also the second current conductor at least substantially comprises a material with an at least substantially isotropic coefficient of thermal expansion, said material preferably being chosen from the group of $Mo_5$ $(Si,X)_3$, wherein X is B, Al, N or C, and more preferable is pentamolybdenum diboride silicide. This simplifies the manufacture of the lamp, as the same components are used for both current conductors. As indicated earlier, these materials ideally meet the requirements of being thermally and chemically stable and having an isotropic coefficient of thermal expansion.

In another preferred embodiment of an electric discharge lamp according to the invention, said material adheres to the ceramic material of the lamp vessel at the manufacturing temperature of the lamp. This allows a very compact lamp construction for the following reasons. The prior art lamp as described in the PCT-patent application mentioned earlier makes use of a sealing compound for sealing the ceramic lamp vessel around the current conductors. As the sealing compound is sensitive to high (operating) temperatures of the lamp, the sealing compound is applied as remote as possible from a central part of the lamp vessel, i.e. at a free end of extended plugs (i.e. elongated end parts) that are connected to the central part of the lamp vessel by means of sintering The use of said extended plugs is undesirable from a technical point of view: said plugs function as cooling fins, thereby negatively influencing an operating temperature in the lamp vessel, whereas capillaries are introduced in said extended plugs. Part of the lamp filling may condensate at the location of the capillaries leading to color instability of the lamp. In the present preferred embodiment, the claimed material $Mo_5$ $(Si,X)_3$, wherein X is B, Al, N or C is co-sintered towards the ceramic lamp vessel at a manufacturing temperature varying between 1500 and 2000° C., so that no separate sealing compound is used, whereas the use of extended plugs being part of the lamp vessel is avoided as well. The present preferred embodiment enables a very compact lamp construction to be achieved, while obviating the prior art disadvantages discussed above.

In another preferred embodiment of an electric discharge lamp according to the invention, the first and the second current conductor each extend from a sealing compound sealing the lamp vessel around the current conductors in a gastight manner to the exterior of the lamp vessel, wherein the lamp vessel has extended plugs in which a respective current conductor is enclosed, which plugs have a free end where the lamp vessel is sealed by the sealing compound.

The invention will now be explained in more detail with reference to two Figures illustrated in a drawing, showing preferred embodiments in a side elevation, partly in cross-section.

FIG. 1 shows an electric discharge lamp in accordance with the invention provided with a tubular, light-transmissive, ceramic lamp vessel 1 made from polycrystalline aluminum oxide, with a first and a second current conductor 2,3. Said conductors 2,3 enter the lamp vessel 1 opposite each other and each support a tungsten electrode 4,5 present in the lamp vessel 1 and welded to the current conductors 2,3. A ceramic sealing compound 6 formed in a melting process by 30% by weight of aluminum oxide, 40% by weight of silicon oxide and 30% by weight of dysprosium oxide, seals the current conductors 2,3 in a gastight manner. The lamp vessel 1 has an ionizable filling comprising argon as a rare gas and a mixture of sodium, thallium and dysprosium iodide as metal halides.

Both the first and the second current conductor 2,3 each have a first halide-resistant part 21,31 within the lamp vessel 1 and, extending from the sealing compound 6 to the exterior of the lamp vessel 1, a second part 22,32 welded to the first part 21,31. The second part 22,32 of the current conductors 2,3 consists of niobium and is entirely incorporated in the sealing compound 6 within the lamp vessel 1. In an alternative embodiment both current conductors 2,3 are each made in one piece of one material being $Mo_5$ $(Si,X)_3$, wherein X is B, Al, N or C, so that the use of a second part 22,32 of niobium is avoided. This is possible because Mo5 (Si,X)3, wherein X is B, Al, N or C, has the same coefficient of thermal expansion as the ceramic material of the vessel 1.

The lamp vessel 1 has narrow end parts or extended plugs 11,12 in which a respective current conductor 2,3 is enclosed. The plugs 11,12 have a free end 111,121, where the lamp vessel 1 is sealed by the sealing compound 6. The central part 10 of the lamp vessel 1 is connected by means of sintering to the plugs 11,12 via ceramic discs 13. The lamp vessel 1 is enveloped by an outer envelope 7 sealed in a gastight manner and evacuated or filled with an inert gas in order to protect the niobium second parts 22,32 of the current conductors 2,3. The outer envelope 7 supports a lamp cap 8.

As indicated earlier, the first part 21,31 of the first and the second current conductor 2,3 consists of a material with an isotropic coefficient of thermal expansion, which material is preferably pentamolybdenum diboride silicide.

Figure 2A:
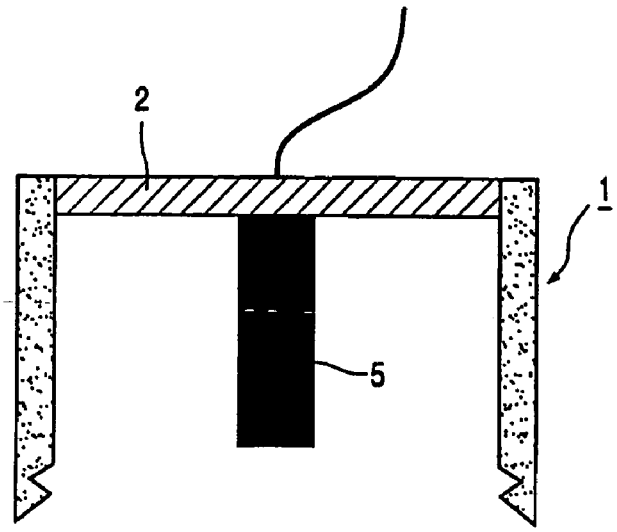
Figure 2B:
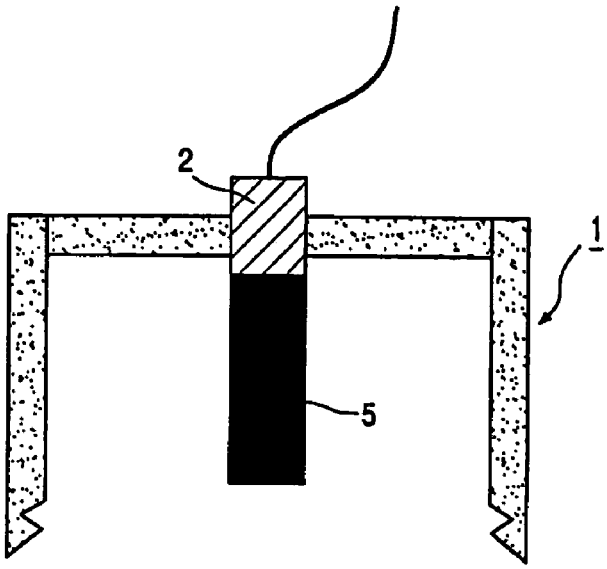

FIG. 2 schematically shows one end of a tubular, light-transmissive, ceramic lamp vessel 1 in accordance with another preferred embodiment, wherein a very compact lamp construction is obtained. The tungsten electrode 5 present in the lamp vessel 1 is attached (preferably welded) to the first current conductor 2. Said first current conductor 2 is co-sintered to the material of the ceramic lamp vessel 1 at a lamp manufacturing temperature varying between 1500 and 2000° C., without using a separate sealing compound 6 as mentioned in the description of FIG. 1. The current conductor 2 consists of the same material as indicated with respect to the first current conductor 2 of FIG. 1. The first current conductor 2 of FIG. 2 may form an end wall of the ceramic lamp vessel 1 (FIG. 2*a*) or may form an extension of the electrode 5 extending through the material of the ceramic lamp vessel 1 (FIG. 2*b*). The other end of the ceramic lamp vessel (not shown in FIG. 2) may have the same construction.

The invention is not restricted to the variant shown in the drawing, but also includes other embodiments that fall within the scope of the appended claims.

What is claimed is:

1. An electric discharge lamp comprising:

a light-transmissive ceramic lamp vessel (1);

a first and a second current conductor (2,3) entering the lamp vessel (1), and each supporting an electrode (4,5) in the lamp vessel (1);

an ionizable filling comprising a rare gas and a metal halide in the lamp vessel (1);

at least the first current conductor (2) within the lamp vessel (1) being halide-resistant, characterized in that the first current conductor (2) at least substantially comprises a material with an at least substantially isotropic coefficient of thermal expansion.

2. An electric discharge lamp according to claim 1, wherein said material is chosen from the group of $Mo_5$ $(Si,X)_3$, wherein X is B, Al, N or C.

3. An electric discharge lamp according to claim 2, wherein said material is pentamolybdenum diboride silicide.

4. An electric discharge lamp according to claim 1, wherein also the second current conductor (3) at least substantially comprises a material with an at least substantially isotropic coefficient of thermal expansion.

5. An electric discharge lamp according to claim 4, wherein said material is chosen from the group of $Mo_5$ $(Si,X)_3$, wherein X is B, Al, N or C preferably is pentamolybdenum diboride silicide.

6. An electric discharge lamp according to claim 1, wherein said material is co-sintered to the ceramic material of the lamp vessel (1) at a manufacturing temperature of the lamp.

7. An electric discharge lamp according to claim 1, wherein the first and the second current conductor (2,3) each extend from a sealing compound (6) sealing the lamp vessel (1) around the current conductors (2,3) in a gastight manner to the exterior of the lamp vessel (1), and wherein the lamp vessel (1) has extended plugs (11,12) in which a respective current conductor (2,3) is enclosed, which plugs (11,12) have a free end (111,112) where the lamp vessel (1) is sealed by the sealing compound (6).

* * * * *